US008203583B2

(12) United States Patent
Wilsher

(10) Patent No.: US 8,203,583 B2
(45) Date of Patent: Jun. 19, 2012

(54) WRITING ERASABLE PAPER USING THERMAL PRINTHEAD AND UV ILLUMINATION

(75) Inventor: Michael John Wilsher, Letchworth (GB)

(73) Assignee: Xerox Corporation, Norwalk, CT (US)

( * ) Notice: Subject to any disclaimer, the term of this patent is extended or adjusted under 35 U.S.C. 154(b) by 396 days.

(21) Appl. No.: 12/640,146

(22) Filed: Dec. 17, 2009

(65) Prior Publication Data

US 2011/0149007 A1 Jun. 23, 2011

(51) Int. Cl.
*B41J 29/16* (2006.01)

(52) U.S. Cl. ..... 347/179

(58) Field of Classification Search ..... 347/179, 347/171–174, 223

See application file for complete search history.

(56) References Cited

U.S. PATENT DOCUMENTS

| | | | | |
|---|---|---|---|---|
| 5,801,743 | A * | 9/1998 | Itoh et al. | 347/171 |
| 6,704,036 | B2 * | 3/2004 | Hayashi et al. | 347/175 |
| 7,936,365 | B2 * | 5/2011 | Jeong | 347/215 |
| 8,130,249 | B2 * | 3/2012 | Brewington et al. | 347/171 |

* cited by examiner

*Primary Examiner* — Kristal Feggins

(74) *Attorney, Agent, or Firm* — MH2 Technology Law Group LLP

(57) ABSTRACT

A system for imaging erasable media includes a thermal print head on a first side of an erasable medium and a UV illumination source opposing the thermal print head and on a second side of the erasable medium. The thermal print head locally heats the erasable medium at a pixel level and the UV illumination source images the erasable medium only at the locally heated regions thereof. Thus the normal roles of uniformly heating the media and imaging with the UV source are reversed.

20 Claims, 3 Drawing Sheets

WRITING ERASABLE PAPER USING THERMAL PRINTHEAD AND UV ILLUMINATION

DESCRIPTION OF THE INVENTION

1. Field of the Invention

This invention relates generally to imaging and, more particularly, to imaging erasable media in an imaging system.

2. Background of the Invention

Paper documents are often promptly discarded after being read. Although paper is relatively inexpensive, the quantity of discarded paper documents is enormous and the disposal of these discarded paper documents raises significant cost and environmental issues. It would, therefore, be desirable for paper documents to be reusable, to minimize both cost and environmental issues.

Erasable media is that which can be reused many times to transiently store images, the images being written on and erasable from the erasable media. For example, photochromic paper employs photochromic materials to provide an imageable surface. Typically, photochromic materials can undergo photoinduced color changes in the photochromic containing layer. In addition, the photoinduced color changes enable imaging and erasure of photochromic paper in sequence on the same paper. For example, a light source of a certain wavelength can be used for imaging erasable media, while heat can be used for inducing erasure of imaged erasable media. An inkless erasable imaging formulation is the subject of U.S. patent application Ser. No. 12/206,136 filed Sep. 8, 2008 and titled "Inkless Reimageable Printing Paper and Method" which is commonly assigned with the present application to Xerox Corp., and is incorporated in its entirety herein by reference.

Because imaging of erasable media has unique requirements, it has previously required dedicated equipment. In particular, a UV source can be required to image the erasable media, and heat can be required to erase an imaged erasable media. In addition, specific temperature parameters can be required for each of the imaging and erasing of erasable media. While traditional imaging devices can be suitable for performing conventional imaging of non-erasable media, their architecture can be insufficient for handling erasable media alone. For example, in order to heat an erasable media to a temperature suitable for UV imaging, it has been known to heat the media sheet while writing the image with a UV writing device. While this can be suitable for some applications, it has been discovered herein, that a more selective heating of the erasable media can be achieved for UV imaging.

Thus, there is a need to provide an imaging device in which erasable media can be imaged under a selective heating of the erasable media.

SUMMARY OF THE INVENTION

According to various embodiments, the present teachings include a system for imaging erasable media. Typically, erasable media is imaged via a UV produced image in combination with a uniform heat source, whereas this invention reverses the roles by writing the image using a thermal print head which produces the image and a uniform UV illumination, the combination producing the photochromic change in the paper. This system includes a thermal print head on a first side of an erasable medium, the thermal print producing the image on the erasable medium; and a uniform UV illumination source opposing the thermal print head and on a second side of the erasable medium, the combination imaging the erasable medium only at the locally heated regions thereof.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments), examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

As used herein, the term "erasable media" refers to transient material that has the appearance and feel of traditional paper, including cardstock and other weights of paper. Erasable media can be selectively imaged and erased.

As used herein, imaged erasable media refers to erasable media having a visible image thereon, the image a result of, for example, ultraviolet (UV) and/or thermal imaging of the erasable media.

As used herein, non-imaged erasable media refers to erasable media which has not been previously imaged, or erasable media having an image erased therefrom and available for UV/thermal imaging. An exemplary erasable medium is described in connection with FIG. 1 below.

As used herein, the term "non-erasable" refers to traditional media of the type used in any conventional imaging such as ink jet, xerography, or liquid ink electrophotography, as known in the art. An example of a non-erasable traditional medium can be conventional paper.

Figure 1:
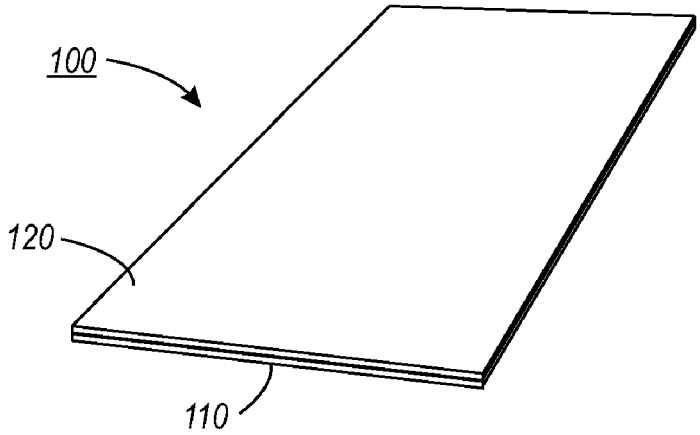
FIG. 1 is a perspective depiction of an erasable medium.

FIG. 1 depicts an exemplary erasable medium 100 in accordance with the present teachings. It should be readily apparent to one of ordinary skill in the art that the erasable medium 100 depicted in FIG. 1 represents a generalized schematic illustration and that other layers can be added or existing layers can be removed or modified.

As shown in FIG. 1, the erasable medium 100 can include a substrate 110 and a photochromic material 120 incorporated into or on the substrate 110. The photochromic material 120 can provide a reversible writing (i.e. erasable) image-forming component on the substrate 110.

The substrate 110 can include, for example, any suitable material such as paper, wood, plastics, fabrics, textile products, polymeric films, inorganic substrates such as metals, and the like. The paper can include, for example, plain papers such as XEROX® 4024 papers, ruled notebook paper, bond paper, and silica coated papers such as Sharp Company silica coated paper, Jujo paper, and the like. The substrate 110, such as a sheet of paper, can have a blank appearance.

In various embodiments, the substrate 110 can be made of a flexible material and can be transparent or opaque. The substrate 110 can be a single layer or multi-layer where each layer is the same or different material and can have a thickness, for example, ranging from about 0.05 mm to about 5 mm.

The photochromic material 120 can be impregnated, embedded or coated to the substrate 110, for example, a porous substrate such as paper. In various embodiments, the photochromic material 120 can be applied uniformly to the substrate 110 and/or fused or otherwise permanently affixed thereto.

Portion(s) of photochromic material of an imaged erasable medium 100 can be erased. In order to produce the transition from a visible image to an erased medium, heat can be applied to the erasable medium 100 at a temperature suitable for effecting the erasure. For example, at a temperature between about 80° C. to about 200° C., the erasable medium 100 can be completely erased. In certain embodiments, the erasable medium can be erased at ambient temperature and with light in the visible spectrum. In order to re-image the erased (or image an original) erasable medium 100, the erasable medium 100 can be heated to a temperature of between about 55° C. to about 80° C. before writing in conjunction with, for example, UV exposure. The image in this embodiment is produced by the thermal head and the UV light is used as the catalyst for rendering visible the image produced by the thermal head. In the previously known processes, the roles are reversed.

It will be appreciated that other types of erasable media, other than photochromic paper, can be used in connection with the exemplary embodiments herein. Such types of erasable media are intended to be included within the scope of the disclosure.

Current technology for erasing and imaging erasable media includes utilizing a heating component, usually in advance of imaging by the UV imaging component. However, in certain environments, it can be advantageous to increase longevity of an image created on erasable media. In order to accomplish increased longevity of the image, it is known to write an image using a UV source at an elevated temperature. Currently, the temperature of the erasable media is increased over an entirety thereof, for example by heating with fuser rollers, heat lamps, heat rollers, etc. Even further, heating of the erasable media is in advance of, or at the same time as, the UV imaging, and under certain conditions, the increased temperature must be maintained until UV imaging can occur. Accordingly, there is no known system which increases the temperature of an erasable medium such that the erasable medium can be UV imaged at an accurate elevated temperature, and further that the accurate elevated temperature is localized to correspond to the UV image created. The following describes an exemplary imaging system capable of processing erasable media at an elevated temperature which is localized to the imaging, even at a pixel level of the image.

Figure 2:
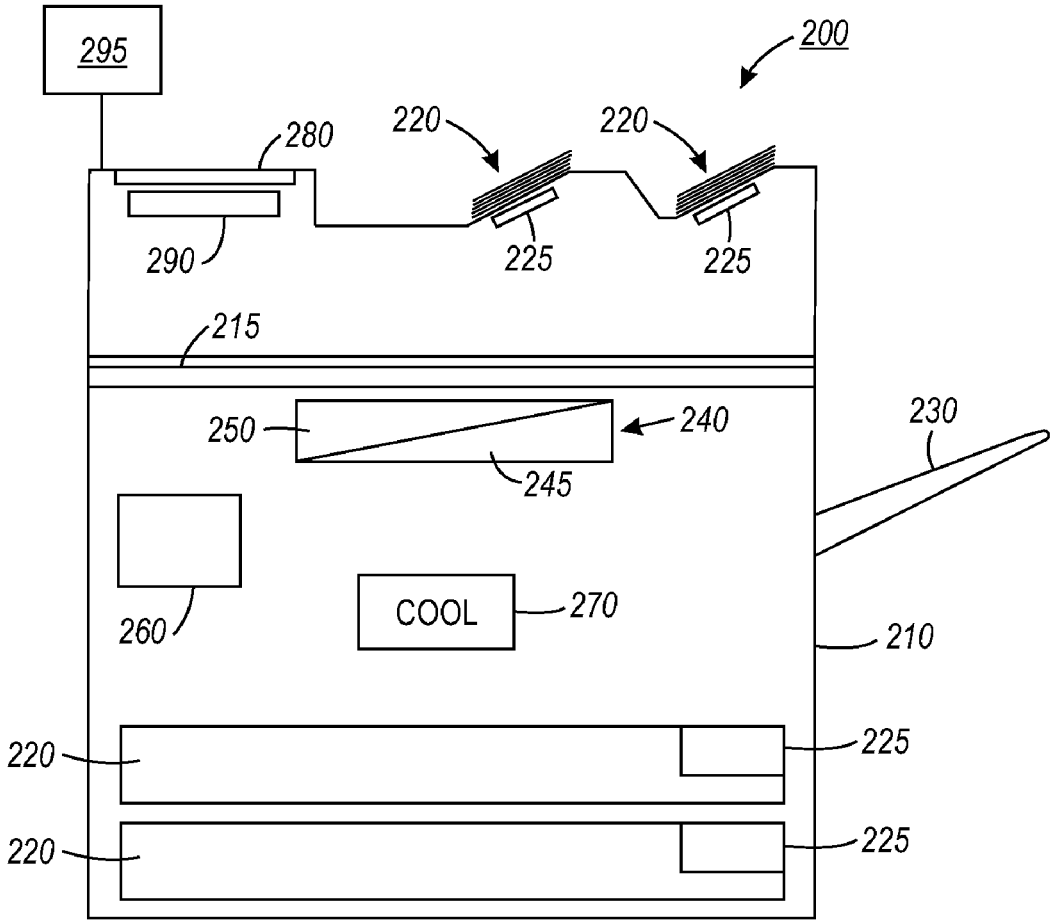
FIG. 2 is a perspective view depicting an imaging device in accordance with the present teachings.

FIG. 2 depicts an exemplary imaging system 200 in accordance with the present teachings. It should be readily apparent to one of ordinary skill in the art that the imaging system 200 depicted in FIG. 2 represents a generalized schematic illustration and that other components can be added or existing components can be removed or modified.

As shown in FIG. 2, the imaging system 200 can include a housing 210 with document input 220 and document output 230 locations. In addition, the imaging system 200 can include a platen 215, a write subsystem 240 including a heating component 250, a cooling subsystem 270, a user interface 280, a control system 290, and an administrator interface 295.

The housing 210 can be of a material and size to accommodate the exemplary components of the imaging system 200. In certain embodiments, the housing 210 can include a desktop device. The housing 210 can further include a full size floor supported device. Sizes for each are known in the art and not intended to limit the scope of the invention.

The media inputs 220 can include an input tray for erasable media. Although the input trays 220 are initially labeled by example as being both interior and exterior to the housing 210, their relative arrangement can be altered according to a configuration of components within the housing 210.

In embodiments, a sensor 225 can be provided to detect erasable media at the input trays 220. The sensor 225 can be proximate each input tray 220, incorporated in the input tray 220, or interior of the housing 210. For example, the sensor 225 can detect an erasable media 100 and control system 290 can select activation of a desired imaging function. Alternatively, a dedicated erasable media tray can be used.

Although not specifically depicted, the erasable media 100 can be transported along an imaging path from an input 220 to output 230 as known in the art. It will be appreciated that the internal configuration of the imaging system 200 can vary according to, for example, consumer requirement and any variation of imaging systems available. Accordingly, the number and type of components depicted herein have been simplified for disclosure purposes.

In embodiments, the write subsystem 240 can include imaging components suitable for imaging erasable media. For example, the write subsystem 240 can include a UV source 245 to UV image an erasable media. Exemplary UV wavelengths are 350 nm to 400 nm however writing of the media may not be limited to this range. In embodiments, UV imaging can be implemented and or enhanced at a predetermined temperature of the erasable media. An exemplary UV imaging temperature of an erasable media can be from about 50° C. to about 80° C. Other UV, IR or similar imaging temperatures can be set according to a type of erasable media and such imaging temperatures are intended to be included within the scope of the invention.

In embodiments, the write subsystem 240 can include a heat source 250. The heat source 250 can heat the erasable medium to a temperature suitable for imaging, for example, UV imaging. The heat source 250 can be positioned on a side of the erasable media opposing the write subsystem 240. The combination of the write subsystem 240 and heat source 250 will be further described in connection with FIG. 3, below.

The erase component 260 can generate an amount of heat sufficient to elevate the erasable medium to a temperature at which an image on the erasable medium can be removed. In embodiments, erase component 260 can include heat plates, rollers, and similar apparatus acting on or adjacent to the erasable medium to heat the erasable medium to an erase temperature. Typically, the erasable medium can pass between or over the erase component 260 according to a type of erase component and imaging system utilized.

In general, the erase component 260 can operate to generate heat in a range of about 80° C. to about 200° C.

Dependant on the internal arrangement, the cooling component 270 can be utilized (although not depicted in FIG. 3), to adjust the temperature of an erasable medium after it has been heated to an erase temperature and prior to imaging at the write subsystem 240. The erasable medium can be lowered to a temperature less than that which will be output by the thermal print head 250.

In embodiments, the cooling component 270 can include active cooling of erasable media. In an active cooling, the cooling component 270 can direct a flow of cooling medium, such as cold air, onto an erasable medium. Active cooling can take place for a period of time and temperature suitable to reduce a temperature of the erasable medium to an ambient temperature. Further, active cooling can take place for a period of time and at a temperature suitable to reduce the temperature of the erasable medium to an imaging temperature, such as a UV imaging temperature. In certain embodiments, active cooling by the cooling component 270 can include a fan. In certain embodiments, active cooling of the erasable medium at the cooling subsystem 270 can include cold plates, rollers, condensers, and similar cooling apparatus acting on or adjacent to the erasable medium.

The cooling subsystem 270 can further be incorporated into the imaging system 200 to cool an imaged erasable medium subsequent to UV imaging. In embodiments, the UV imaged erasable medium can therefore be cooled prior to discharge from the imaging system 200 into the output tray 230.

In embodiments, a user interface 280 can be provided in the housing 210. The user interface 280 can include control components, responsive to user input, for directing the functions of the imaging system 200. In embodiments, an administrator interface 295 can be provided via a network connection to the housing 210. The administrator interface 295 can include control options directing the functions of the imaging system.

Job selection can be executed at the user interface 280. Alternatively, job selection can be executed at the administrator interface 295. In another alternative, job selection can be executed at a user's personal computer print dialog box through the properties link to the print driver controls. The user interface 280 can further be responsive to the sensor 225 and the sensor 225 can be responsive to input at the user interface 280.

Figure 3:
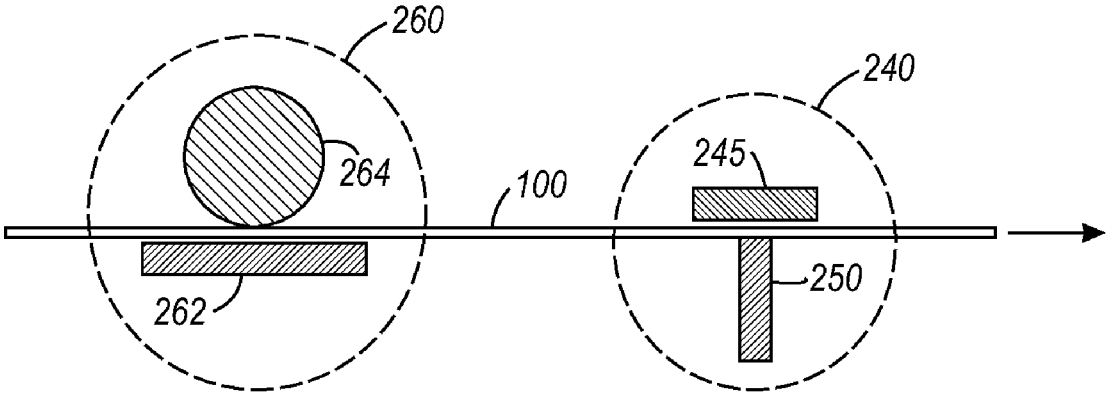
FIG. 3 is a side view depicting a combined heating and writing configuration of the imaging device of FIG. 2 in accordance with the present teachings.

FIG. 3 depicts exemplary details of each of the erase component 260 and the write subsystem 240 of FIG. 2, in accordance with the present teachings. The write subsystem 240 can be provided to selectively heat and image an erasable media within the imaging device 200. Effective erasable media imaging requires the erasable media to be heated to a specified temperature during the writing process in combination with UV illumination.

The write subsystem 240 can provide localized heating of an erasable media as part of a write operation. It should be readily apparent to one of ordinary skill in the art that the write subsystem 240 depicted in FIG. 3 represents a generalized schematic illustration and that other components can be added or existing components can be removed or modified.

Current versions of erasable media, particularly that utilizing UV writing on erasable photochromic media, require heating the erasable medium. Heating can be to a temperature between about 55° C. to about 80° C. Exemplary architecture herein can maintain the erasable media at a desired temperature without wasting energy.

As shown in FIG. 3, the write subsystem 240 is depicted in connection with the erase component 260, for purposes of description. The write subsystem 240 can include a UV source 245 and an imaging heat source 250. The imaging heat source 250 can include, and hereafter referred to as, a thermal print head.

The UV source 245 and thermal print head 250 are depicted relative to the erasable medium 100. As depicted, the erasable medium 100 can be interposed between the UV source 245 and the thermal print head 250. It will be appreciated that the erasable medium 100 is shown as a continuous sheet between the erase component 260 and write subsystem 240; however, this depiction is for simplicity and discreet sheets of erasable media can be implemented. Each of the UV source 245 and thermal print head 250 can be static with respect to the erasable medium 100.

The thermal print head 250 can be implemented to generate heated spots on the erasable medium 100 with an array of fast-acting heating elements. In operation, and in the presence of the erasable medium, the imaging device 200 can send an electrical current to the heating resistors of the thermal print head 250, which in turn generates heat in a prescribed pattern on the erasable medium 100. The thermal print head 250 can therefore heat individual pixels of an image. The heat can transmit through the erasable medium 100 to a side of the erasable medium facing the UV imaging source 245.

The UV imaging source 245 can illuminate the erasable medium 100 from a side of the erasable medium opposite that of the thermal print head 250, as depicted. The UV imaging source 245 can utilize flood illumination over substantially an entire surface of the erasable medium 100, however only the image defined by the heat transmitted through the erasable medium 100 will be imaged by the UV illumination. The UV imaging source 245 can utilize flood illumination over less than an entire surface of the erasable medium 100, for example, to substantially correspond to a size of the image defined by the thermal print head 250. Accordingly, the static UV source 245 can illuminate one side of the erasable medium 100, and thereby generate an image as defined by heated pixels of the thermal print head 250, as part of a write operation.

As described above in connection with FIG. 2, the erase component 260 can function to elevate an erasable medium to a temperature at which an image can be removed from the erasable medium. Even further, the erase component 260 can be positioned in advance of the write subsystem 240. The erase component 260 can include a support member 262 and a roller 264. Although the roller 264 is depicted as positioned on a side of the erasable medium as that of the UV source 254, the positions can be reversed and the illustration is not intended to be limiting. Further, the support member 262 can be of a size to span a potential width of an erasable member passing thereover. The roller 264 can be one or more rollers spanning a width of the erasable medium, and at least of a size and position to advance the erasable medium within the system 200. One or both of the support member 262 and roller 264 can include heating components, for example resistive type heating components.

Although not specifically depicted, it will be appreciated from the description in connection with FIG. 2 and FIG. 3 that the cooling component 270 can be positioned intermediate the erase component and write subsystem 240, and/or subsequent to the write subsystem 240 if required.

In operation, the imaging device 200 can image an erasable medium utilizing the thermal print head on a first side of the erasable medium and the UV illumination on the side of the erasable medium to be imaged. An exemplary operation is described in connection with FIG. 4 below.

Figure 4:
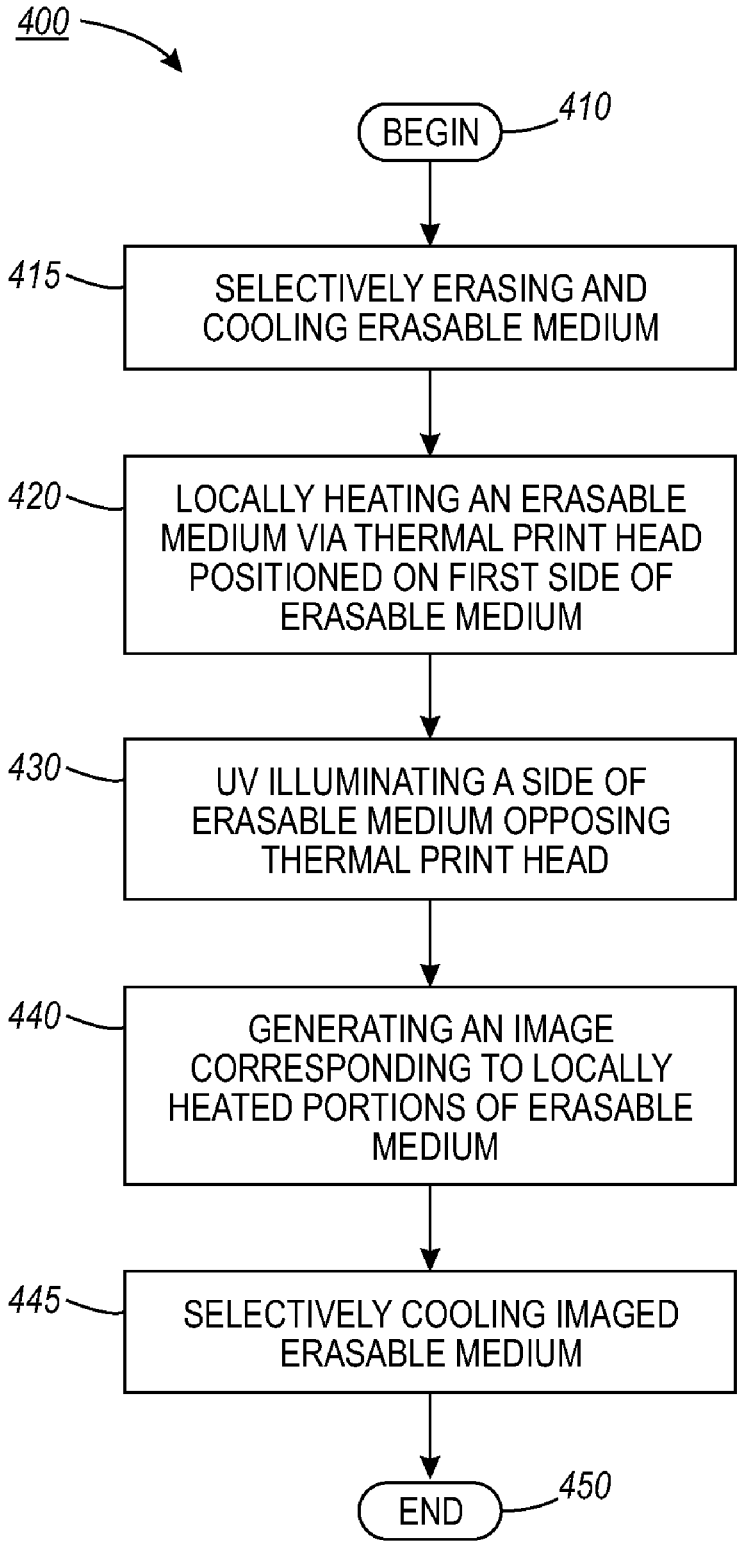
FIG. 4 depicts an exemplary method of imaging in accordance with the present teachings.

FIG. 4 depicts an exemplary method 400 of writing on erasable media in accordance with the present teachings. It should be readily apparent to one of ordinary skill in the art that the method represents a generalized method and that other steps can be added or existing steps can be removed or modified.

The method 400 begins at 410. At 420, the method includes locally heating an erasable medium via a thermal print head positioned on a first side of the erasable medium. Locally heating can include heating the erasable medium in a pattern corresponding to individual pixels of an image subject to UV/thermal imaging.

At 430, the method includes illuminating a side of an erasable medium opposing the thermal print head. Illumination is with a UV illumination source. The UV illumination can include flood illumination or UV illumination directed to a defined region of the erasable medium. As such, the illuminating can include uniformly illuminating one side of an erasable medium over a predetermined area.

At 440, the method can include generating an image on the illuminated erasable medium, the image corresponding to locally heated portions of the erasable medium.

At 450, the method can conclude.

It will be appreciated that certain steps of erase using the erase component 260 and cooling using the cooling component 270 can be included in the steps above. The variations can include erasing an erasable medium, followed by cooling the erased erasable medium at 415, followed by UV/thermal imaging the cooled erasable medium in the remaining steps. UV/thermal imaging utilizes the thermal print head 250 and UV source as described herein. In another configuration, the method can omit each of the erase and cooling steps in the event that a non-imaged erasable medium enters the system 200 although it is also acceptable to pass the non-imaged media through these steps without detriment. With this configuration, the erasable medium needs no erasure or subsequent cooling and can proceed directly to the imaging subsystem 240 utilizing the UV source 245 and thermal print head 250 therein. Even further, the erasable medium imaged by either of the two scenarios above can be cooled at 445 subsequent to UV/thermal imaging, if required, and prior to discharge from the device 200. Various other steps can be implemented according to customer need and device specifications. Such modifications are intended to be included herein.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for imaging erasable media, the system comprising:

a thermal print head on a first side of an erasable medium, the thermal print head locally heating the erasable medium; and a UV illumination source opposing the thermal print head and on a second side of the erasable medium, the UV illumination source imaging the erasable medium only at the locally heated regions thereof.

2. The system of claim 1, wherein the locally heated regions comprises individual pixels heated by the thermal print head.

3. The system of claim 1, wherein individual pixels are heated to write under flood illumination.

4. The system of claim 2, wherein the UV illumination source comprises flood illumination.

5. The system of claim 1, wherein each of the UV illumination source and thermal print head are stationary.

6. The system of claim 1, wherein the UV illumination uniformly illuminates one side of an erasable media over a predetermined area.

7. The system of claim 1, wherein the static UV illumination source comprises an LED array.

8. The system of claim 1, wherein the static UV illumination source comprises a single UV LED and a light guide.

9. The system of claim 1, wherein the static UV illumination source comprises fluorescent tubes.

10. The system of claim 1, wherein the thermal print head comprises a spatial resolution of about 150 dpi to 1200 dpi.

11. The system of claim 1, wherein the erasable media imaging temperature is in a range of about 55° C. to about 80° C.

12. A method of writing on erasable media, the method comprising:

locally heating an erasable medium via a thermal print head positioned on a first side of the erasable medium;

illuminating a side of an erasable medium opposing the thermal print head, with a UV illumination source; and generating an image on the illuminated erasable medium, the image generated by corresponding to a combination of locally heating portions of the erasable medium and illuminating with the UV illumination source.

13. The method of claim 12, wherein locally heating comprises heating the erasable medium in a pattern corresponding to individual pixels of an image subject to UV imaging.

14. The method of claim 12, wherein illuminating comprise uniformly illuminating one side of an erasable media over a predetermined area.

15. The method of claim 12, further comprising selectively erasing an imaged erasable medium in advance of said generating an image.

16. The method of claim 12, further comprising selectively cooling an imaged erasable medium in advance of said generating an image.

17. The method of claim 12, further comprising selectively erasing and cooling an imaged erasable medium in advance of said generating an image.

18. The method of claim 12, wherein illuminating comprises illuminating with a static UV illumination source comprising an LED array.

19. The method of claim 12, wherein illuminating comprises illuminating with a static UV illumination source comprising a single UV LED and a light guide.

20. The method of claim 12, wherein illuminating comprises illuminating with a static UV illumination source comprising fluorescent tubes.

* * * * *